US007286039B2

(12) United States Patent
Yoneda

(10) Patent No.: US 7,286,039 B2
(45) Date of Patent: Oct. 23, 2007

(54) CHIP RESISTOR AND METHOD OF MANUFACTURING THE SAME

(75) Inventor: Masaki Yoneda, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 43 days.

(21) Appl. No.: 10/572,158

(22) PCT Filed: Sep. 17, 2004

(86) PCT No.: PCT/JP2004/013621

§ 371 (c)(1),
(2), (4) Date: Mar. 16, 2006

(87) PCT Pub. No.: WO2005/027150

PCT Pub. Date: Mar. 24, 2005

(65) Prior Publication Data

US 2007/0035379 A1 Feb. 15, 2007

(30) Foreign Application Priority Data

Sep. 17, 2003 (JP) ..... 2003-324980
Sep. 17, 2003 (JP) ..... 2003-324981

(51) Int. Cl.
*H01C 1/012* (2006.01)

(52) U.S. Cl. ..... 338/308; 338/309; 338/283; 338/195; 340/641

(58) Field of Classification Search ..... 338/307–309, 338/195, 206, 292–293, 283; 340/641–643
See application file for complete search history.

(56) References Cited

U.S. PATENT DOCUMENTS 4,368,093 A * 1/1983 Hay, II ..... 156/443
4,588,976 A * 5/1986 Jaselli ..... 338/284
5,223,820 A * 6/1993 Sutterlin et al. ..... 340/641
5,379,016 A * 1/1995 Smith et al. ..... 338/308
6,441,718 B1 * 8/2002 Smejkal et al. ..... 338/329
6,548,758 B2 * 4/2003 Gotoh et al. ..... 174/520
2004/0012479 A1 1/2004 Yamada et al.

FOREIGN PATENT DOCUMENTS

| | | |
|---|---|---|
| JP | 7-302704 | 11/1995 |
| JP | 8-31623 | 2/1996 |
| JP | 9-205004 | 8/1997 |
| JP | 2001-338801 | 12/2001 |
| JP | 2002-338801 | 11/2002 |
| JP | 2003-22902 | 1/2003 |

* cited by examiner

*Primary Examiner*—Richard K. Lee
(74) *Attorney, Agent, or Firm*—Hamre Schumann Mueller & Larson, P.C.

(57) ABSTRACT

A chip resistor is provided which includes a resistor film 5 formed between a pair of terminal electrodes 2 and 3 on an upper surface of an insulating substrate 2. The resistor film is formed with two inward grooves 7, 8 and two trimming grooves 9, 10 which are alternately provided for causing the current path in the resistor film to have a winding shape. The two inward grooves 7 and 8 are provided approximately at the midpoint between one end edge 5*a* and the other end edge 5*b* of the resistor film 5. The trimming groove 9 is provided between the inward groove 8 and the end edge 5*a* of the resistor film, whereas the other trimming groove 10 is provided between the inward groove 7 and the end edge 5*b* of the resistor film, whereby the time required for the trimming adjustment to adjust the resistance to a predetermined value is shortened, and the yield rate is reduced to reduce the cost.

6 Claims, 5 Drawing Sheets

CHIP RESISTOR AND METHOD OF MANUFACTURING THE SAME

TECHNICAL FIELD

The present invention relates to a chip resistor comprising a resistor film formed on an insulating substrate in the form of a chip. The invention particularly relates to a chip resistor having improved surge resistance and to a method of manufacturing such a chip resistor.

BACKGROUND ART

Generally, a chip resistor having a resistor film formed on an insulating substrate in the form of a chip has a drawback that its resistance is likely to change when surge voltage generated due to the influence of static electricity or power supply noise is applied. It is known that the change of resistance due to surge voltage can be suppressed by increasing the length of the current path in the resistor film.

The Patent Documents 1 and 2 as the prior art disclose chip resistors designed to improve the surge resistance.

Specifically, as shown in FIG. 13, the chip resistor 1' disclosed in the Patent Document 1 includes an insulating substrate 2' in the form of a chip, terminal electrodes 3' and 4' formed on the upper surface of the insulating substrate at longitudinally opposite ends thereof, and a resistor film 5' having a width W and formed by screen printing on the upper surface of the insulating substrate 2' to extend longitudinally of the insulating substrate 2' between the terminal electrodes 3' and 4'. In screen printing the resistor film 5', a first and a second longitudinally opposite end edges 5*a* and 5*b* of the resistor film 5' are electrically connected to the terminal electrodes 3' and 4' throughout the width W of the resistor film 5'. Further, the resistor film 5' includes a first inward groove 7' extending from a first longitudinal edge 5*c'* toward a second longitudinal edge 5*d'* of the resistor film 5' and a second inward groove 8' extending from the second longitudinal edge 5*d'* toward the first longitudinal edge 5*c'*, which are formed in screen printing the resistor film. Specifically, the first inward groove 7' and the second inward groove 8' are provided approximately at the longitudinal center of the resistor film 5' and arranged adjacent to each other so that the first inward groove 7' is positioned closer to the second end edge 5*b'* of the resistor film 5' than the second inward groove is, whereas the second inward groove 8' is positioned closer to the first end edge 5*a'* of the resistor film 5' than the first inward groove is.

Further, between the first end edge 5*a'* and the second inward groove 8' of the resistor film 5' is further provided a first trimming groove 9', which is formed by e.g. laser beam irradiation to extend from the first longitudinal edge 5*c'* toward the second longitudinal edge 5*d'*. Similarly, between the second end edge 5*b'* and the first inward groove 7' of the resistor film 5' is provided a second trimming groove 10', which is formed by e.g. laser beam irradiation to extend from the second longitudinal edge 5*d'* toward the first longitudinal edge 5*c'*. Due to the provision of the two inward grooves 7', 8' and the two trimming grooves 9', 10', the resistor film 5' has a winding shape. In this way, the length of the current path in the resistor film 5' is increased as much as possible.

The chip resistor 21' disclosed in the Patent Document 2 has such a structure as shown in FIG. 14. Specifically, the chip resistor includes an insulating substrate 22' in the form of a chip, terminal electrodes 23' and 24' formed on the upper surface of the insulating substrate 22' at longitudinally opposite ends thereof, and a resistor film 25' having a width W and formed by screen printing on the upper surface of the insulating substrate 22' to extend longitudinally of the insulating substrate 22 between the terminal electrodes 23' and 24'. In screen printing the resistor film, a first narrow portion 26' is provided integrally at the first end edge 25*a'* of the resistor film 25'. Of a first and a second longitudinal edges 25*c'* and 25*d'* of the resistor film 25', the first narrow portion 26' is provided at the first longitudinal edge 25*c'*, and the first end edge 25*a'* is electrically connected to the terminal electrode 23' through the first narrow portion 26'. Further, in screen printing, a second narrow portion 27' is provided integrally at the second end edge 25*b'* of the resistor film 25'. The second narrow portion 27' is provided at the second longitudinal edge 25*d'* of the resistor film, and the second end edge 25*b'* is electrically connected to the terminal electrode 24' through the second narrow portion 27'. Further, the resistor film 25' includes a first inward groove 28' formed adjacent to the second end edge 25*b'* of the resistor film 25' to extend from the second longitudinal edge 25*d'* toward the first longitudinal edge 25*c'*, and a second inward groove 29' formed adjacent to the first end edge 25*a'* of the resistor film 25' to extend from the first longitudinal edge 25*c'* toward the second longitudinal edge 25*d'*, which are formed in screen printing the resistor film 25'.

Further, a first trimming groove 30' is provided between the two inward grooves 28' and 29' of the resistor film 25' and at a position offset toward the first inward groove 28'. The first trimming groove is formed by e.g. laser beam irradiation to extend from the second longitudinal edge 25*d'* toward the first longitudinal edge 25*c'*. Further, a second trimming groove 31' is provided between the two inward grooves 28' and 29' of the resistor film 25' and at a position offset toward the second inward groove 29'. The second trimming groove is formed by e.g. laser beam irradiation to extend from the second longitudinal edge 25*d'* toward the first longitudinal edge 25*c'* Due to the provision of the two inward grooves 28', 29' and the two trimming grooves 30', 31', the resistor film 25' has a winding shape. In this way, the length of the current path in the resistor film 25' is increased as much as possible.

Patent Document 1: JP-A-2002-338801

Patent Document 2: JP-A-H09-205004

DISCLOSURE OF THE INVENTION

Problems to be Solved by the Invention

With the structure disclosed in the Patent Document 1 (FIG. 13), the winding shape of the resistor film 5' provided by the two inward grooves 7', 8' and the two trimming grooves 9', 10' increases the length of the current path, whereby the surge resistance is reliably improved while keeping the size and weight of the chip resistor small.

However, of the four grooves 7', 8', 9' and 10', the two trimming grooves 9' and 10' are provided at portions of the resistor film 5' which are connected to the terminal electrodes 3' and 4' throughout the width W, which causes the following problems.

(1) The two trimming grooves 9' and 10' are formed to increase the number of turns in the winding shape of the resistor film 5' for increasing the length of the current path and also to adjust the resistance between the terminal electrodes 3' and 4' to the rated range. Since the two trimming grooves 9' and 10' are formed at portions of the resistor film 5' which are connected to the terminal electrodes 3' and 4' throughout the width W, the rate of change of the resistance per unit length of the trimming grooves 9' and 10' is small. Therefore, the forming of the trimming grooves 9' and 10' while measuring the resistance between the terminals 3' and 4' to adjust the resistance to the rated range takes a long time and reduces the productivity.

(2) The resistor film 5' is inherently so designed that the difference between the resistance before the trimming grooves 9' and 10' are formed and that after the trimming grooves 9' and 10' are formed becomes small. Therefore, when the rate of change of the resistance per unit length is equal between the two trimming grooves 9' and 10', the yield of the adjustment of the resistance to the rated range decreases, which, in combination with the low productivity, increases the manufacturing cost.

(3) In forming the trimming grooves 9' and 10' by trimming, the positions where the trimming grooves are formed deviate in the longitudinal direction of the resistor film. Due to the positional deviation, either or both of the distance S1 between the first trimming groove 9' and the second inward groove 8' and the distance S2 between the second trimming groove 10' and the first inward groove 7' of the resistor film 5' may become smaller than a predetermined value such as the distance S0 between the two inward grooves 7' and 8' of the resistor film 5', resulting in a defective product. In this way, the possibility of producing a defective increases.

The structure disclosed in the Patent Document 2 includes narrow portions 26' and 27' provided at opposite ends of the resistor film 25' to overlap the terminal electrodes 23' and 24'. As compared with the structure of the Patent Document 1 in which an end of the resistor film 25' is connected to the terminal electrode without reducing the width, i.e. without the intervention of a narrow portion, the resistor film of the Patent Document 2 includes a larger number of turns in the winding shape. Thus, the length of the current path in the resistor film is increased without increasing the length of the insulating substrate 22, so that the surge resistance is considerably improved without while keeping the size and weight of the chip resistor small.

However, of the four grooves 28', 29', 30' and 31', two trimming grooves 30' and 31' are arranged adjacent to each other, which causes the following problem.

The two trimming grooves 30' and 31' are formed individually to increase the number of turns in the winding shape of the resistor film for increasing the length of the current path and also to adjust the resistance between the terminal electrodes 23' and 24' to the rated range. In the trimming to form the grooves, the positions where the trimming grooves are formed deviate in the longitudinal direction of the resistor film.

In this case, since the two trimming grooves 30' and 31' are arranged adjacent to each other, when the trimming grooves 30' and 31' come close to each other due to the positional deviation in the individual trimming, the distance S1 between the two trimming grooves 30' and 31' may become smaller than a predetermined value such as the distance S0 between the end edge **25*b*' of the resistor film 25' and the first inward groove 28' or the distance S0 between the end edge 25*a* and the second inward groove 29'**, resulting in a defective product. In this way, the possibility of producing a defective increases.

The production of a defective may be prevented by keeping, in advance, a wide space between the positions where the two trimming grooves 30' and 31' are to be formed in consideration of the positional deviation in the trimming. However, to keep such a wide space, the length of the insulating substrate 22 need be increased correspondingly, which leads to an increase in size and weight.

The first aspect of the present invention aims to solve the above-described problems of the chip resistor disclosed in the Patent Document 1, whereas the second aspect of the present invention aims to solve the above-described problems of the chip resistor disclosed in the Patent Document 2.

Means for Solving the Problems

According to the first aspect of the present invention, there is provided a chip resistor comprising an insulating substrate in the form of a chip, a pair of terminal electrodes formed on an upper surface of the insulating substrate at opposite ends of the upper surface, and a resistor film formed by screen printing on the upper surface of the insulating substrate and elongated between the terminal electrodes to have a predetermined width to include a first and a second longitudinal edges and a first and a second end edges. The resistor film includes a first inward groove extending from the first longitudinal edge toward the second longitudinal edge, and a second inward groove extending from the second longitudinal edge toward the first longitudinal edge, and the first and the second inward grooves are formed simultaneously in forming the resistor film by screen printing. The first end edge of the resistor film is electrically connected to one of the terminal electrodes throughout the width of the resistor film, whereas the second end edge of the resistor film is electrically connected to the other one of the terminal electrodes via a narrow portion provided at the second longitudinal edge, and the first and the second inward grooves are provided approximately at the longitudinal center of the resistor film and arranged adjacent to each other so that the first inward groove is positioned closer to the second end edge than the second inward groove is, whereas the second inward groove is positioned closer to the first end edge than the first inward groove is. The resistor film further includes a first trimming groove formed between the first end edge of the resistor film and the second inward groove by trimming and extending from the first longitudinal edge toward the second longitudinal edge, and a second trimming groove formed between the second end edge of the resistor film and the first inward groove by trimming and extending from the second longitudinal edge toward the first longitudinal edge.

In this arrangement, of the two trimming grooves formed in the resistor film by trimming, the first trimming groove is provided at a portion of the resistor film which is connected to the terminal electrode throughout the width. Therefore, the rate of change of resistance per unit length of the first trimming groove is relatively small similarly to the prior art structure.

On the other hand, of the two trimming grooves, the second trimming groove is provided between the first inward groove and the second end edge of the resistor film, which is connected to the other terminal electrode through the narrow portion. Therefore, the rate of change of resistance per unit length of the second trimming groove is larger than that of the first trimming groove.

Therefore, to make the resistance between the terminal electrodes lie in the predetermined rated range, the second trimming groove whose rate of resistance change is large is first formed to roughly adjust the resistance to come close to the predetermined rated value. Subsequently, the first trimming groove, whose rate of resistance change is small, is formed. With this technique, precise trimming adjustment to make the resistance lie within the predetermined rated range is possible.

Therefore, the time required for the trimming adjustment for adjusting the resistance to the rated range, which is performed by forming the two trimming grooves while measuring the resistance between the two terminal electrodes, can be shortened owing to the rough trimming adjustment in forming the second trimming groove before the precise adjustment in forming the first trimming groove. As a result, the productivity and the yield can be enhanced, which leads to the reduction of the manufacturing cost.

Further, in the first aspect, each of the distance between the first trimming groove and the second inward groove, the distance between the first inward groove and the second trimming groove and the distance between the second end edge of the resistor film and the second trimming groove is set larger than the distance between the first inward groove and the second inward groove by as much as the amount of positional deviation in trimming to form the trimming grooves. With this arrangement, in the resistor film, each of the distance between the first trimming groove and the second inward groove, the distance between the first inward groove and the second trimming groove and the distance between the second end edge of the resistor film and the second trimming groove can be prevented from becoming smaller than the distance between the two inward grooves due to the positional deviation in forming the trimming grooves. Therefore, the production of a defective is reliably prevented.

In the first aspect, a method of manufacturing a chip resistor may be employed which comprises the steps of forming terminal electrodes on an upper surface of an insulating substrate in the form of a chip at opposite ends of the upper surface, and forming a resistor film between the terminal electrodes on the upper surface of the insulating substrate by screen printing so that the resistor film includes a first and a second longitudinal edges and a first and a second end edges. The step of forming the resistor film by screen printing includes electrically connecting the first end edge of the resistor film to one of the terminal electrodes throughout the width of the resistor film, forming a narrow portion integrally at the second end edge of the resistor film so that the narrow portion is electrically connected to the other one of the terminal electrodes at the second longitudinal edge of the resistor film, and forming a first inward groove extending from the first longitudinal edge toward the second longitudinal edge and a second inward groove extending from the second longitudinal edge toward the first longitudinal edge in the resistor film. The method further comprises the step of forming, by trimming, a first trimming groove extending from the first longitudinal edge toward the second longitudinal edge between the first end edge of the resistor film and the second inward groove and the step of forming, by trimming, a second trimming groove extending from the second longitudinal edge toward the first longitudinal edge between the second end edge of the resistor film and the first inward groove.

According to the second aspect of the present invention, there is provided a chip resistor comprising an insulating substrate in the form of a chip, a pair of terminal electrodes formed on an upper surface of the insulating substrate at opposite ends of the upper surface, and a resistor film formed by screen printing on the upper surface of the insulating substrate and elongated between the terminal electrodes to have a predetermined width to include a first and a second longitudinal edges and a first and a second end edges. The resistor film includes a first narrow portion integrally formed at the first end edge and electrically connected to one of the terminal electrodes at the first longitudinal edge of the resistor film, a second narrow portion integrally formed at the second end edge and electrically connected to the other one of the terminal electrodes at the second longitudinal edge of the resistor film, a first inward groove extending from the first longitudinal edge toward the second longitudinal edge, and a second inward groove extending from the second longitudinal edge toward the first longitudinal edge. The first and the second inward grooves are formed simultaneously in forming the resistor film by screen printing. The first and the second inward grooves are provided approximately at the longitudinal center of the resistor film and arranged adjacent to each other so that the first inward groove is positioned closer to the second end edge than the second inward groove is, whereas the second inward groove is positioned closer to the first end edge than the first inward groove is. The resistor film further includes a first trimming groove formed between the first end edge of the resistor film and the second inward groove by trimming and extending from the first longitudinal edge toward the second longitudinal edge, and a second trimming groove formed between the second end edge of the resistor film and the first inward groove by trimming and extending from the second longitudinal edge toward the first longitudinal edge.

With this arrangement, the number of turns in the winding shape of the resistor film, which is provided by the two inward grooves and the two trimming grooves, can be made equal to that in the prior art structure. On the other hand, unlike the prior art structure, the first trimming groove and the second trimming groove are not arranged adjacent to each other but spaced from each other with the two inward grooves interposed therebetween. Therefore, even when the trimming grooves come close to each other due to the positional deviation in individually forming the grooves by trimming, the distances between the two inward grooves and the two trimming grooves can be reliably prevented from becoming smaller than a predetermined value without the need for increasing the length of the insulating substrate.

As a result, the possibility of producing a defective can be considerably reduced without increasing the size and weight of products.

In the second aspect, each of the distance between the first end edge of the resistor film and the first trimming groove, the distance between the first trimming groove and the second inward groove, the distance between the first inward groove and the second trimming groove and the distance between the second end edge of the resistor film and the second trimming groove is set larger than distance between the first inward groove and the second inward groove by as much as the amount of positional deviation in trimming to form the trimming grooves. With this arrangement, the distances between the inward grooves and trimming grooves can be prevented from becoming smaller than the distance between the two inward grooves due to the positional deviation in forming the trimming grooves which are formed simultaneously in forming the resistor film by screen printing. Therefore, the possibility of producing a defective is reliably reduced.

In the second aspect, a method of manufacturing a chip resistor may be employed which comprises the steps of forming terminal electrodes on an upper surface of an insulating substrate in the form of a chip at opposite ends of the upper surface, and forming a resistor film between the terminal electrodes on the upper surface of the insulating substrate by screen printing so that the resistor film includes a first and a second longitudinal edges and a first and a second end edges. The step of forming the resistor film by screen printing includes forming a first narrow portion integrally at the first end edge of the resistor film so that the first narrow portion is electrically connected to the one of the terminal electrodes at the first longitudinal edge of the resistor film, forming a second narrow portion integrally at the second end edge of the resistor film so that the second narrow portion is electrically connected to the other one of the terminal electrodes at the second longitudinal edge of the resistor film, and forming a first inward groove extending from the first longitudinal edge toward the second longitudinal edge and a second inward groove extending from the second longitudinal edge toward the first longitudinal edge in the resistor film. The method further comprises the step of forming, by trimming, a first trimming groove extending from the first longitudinal edge toward the second longitudinal edge between the first end edge of the resistor film and the second inward groove and the step of forming, by trimming, a second trimming groove extending from the second longitudinal edge toward the first longitudinal edge between the second end edge of the resistor film and the first inward groove.

Other objects, features and advantages of the present invention will become apparent from the detailed description given below with reference to the accompanying drawings.

BEST MODE FOR CARRYING OUT THE INVENTION

Preferred embodiments of the present invention will be described below in detail with reference to the drawings.

Figure 1:
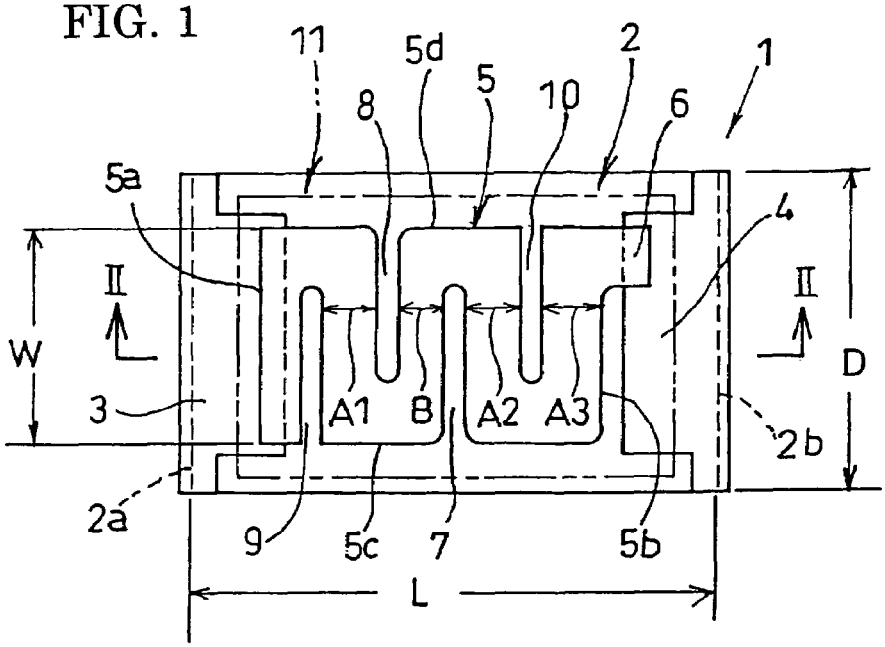
FIG. 1 is a plan view showing a chip resistor according to a first embodiment of the present invention.
Figure 2:
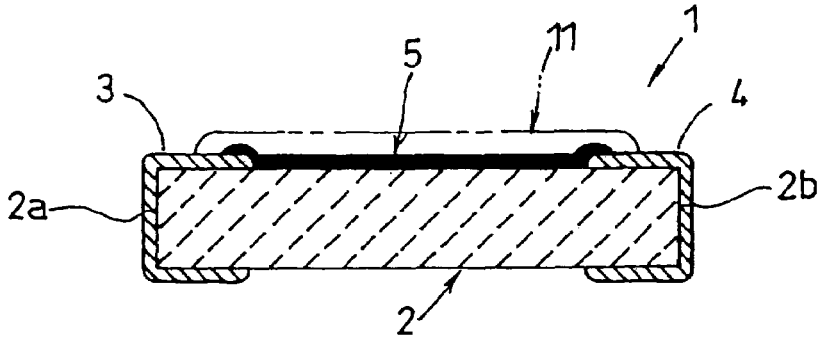
FIG. 2 is a sectional view taken along lines II-II in FIG. 1.

FIGS. 1 and 2 show a chip resistor 1 according to a first embodiment of the present invention.

The chip resistor 1 includes an insulating substrate 2 in the form of an elongated rectangular chip having a width D and a length L, terminal electrodes 3 and 4 formed on the upper surface of the insulating substrate at longitudinally opposite ends thereof, and a resistor film 5 having a width W and formed on the upper surface of the insulating substrate 2 to extend longitudinally of the insulating substrate 2 between the terminal electrodes 3 and 4. The resistor film is formed by screen printing and the subsequent baking of the material.

The resistor film 5 has a first and a second end edges 5*a* and 5*b*Specifically, in screen printing the resistor film, the first end edge 5*a* of the resistor film 5 is formed to overlap and to be connected to the terminal electrode 3 throughout the width W, whereas a narrow portion 6 is provided integrally at the second end edge 5*b* of the resistor film 5. Of a first and a second longitudinal edges 5*c* and 5*d* of the resistor film 5, the narrow portion is provided at the second longitudinal edge 5*d*, and the second end edge 5*b* of the resistor film is electrically connected to the terminal electrode 4 through the narrow portion 6. Further, the resistor film 5 includes a first inward groove 7 extending from the first longitudinal edge 5*c* toward the second longitudinal edge 5*d* and a second inward groove 8 extending from the second longitudinal edge 5*d* toward the first longitudinal edge 5*c*, which are formed in screen printing the resistor film.

Specifically, the first inward groove 7 and the second inward groove 8 are provided approximately at the longitudinal center of the resistor film 5 and arranged adjacent to each other so that the first inward groove 7 is positioned closer to the second end edge 5*b* of the resistor film 5 than the second inward groove is, whereas the second inward groove 8 is positioned closer to the first end edge 5*a* of the resistor film 5 than the first inward groove is.

Between the first end edge 5*a* and the second inward groove 8 of the resistor film 5 is further provided a first trimming groove 9, which is formed by e.g. laser beam irradiation to extend from the first longitudinal edge 5*c* toward the second longitudinal edge 5*d*. Similarly, between the second end edge 5*b* and the first inward groove 7 of the resistor film 5 is provided a second trimming groove 10, which is formed by e.g. laser beam irradiation to extend from the second longitudinal edge 5*d* toward the first longitudinal edge 5*c*. Due to the provision of the two inward grooves 7, 8 and the two trimming grooves 9, 10, the resistor film 5 has a winding shape.

Indicated by the reference sign 11 is a cover coat, which is formed to entirely cover the resistor film 5 after the two trimming grooves 9 and 10 are formed by trimming. The opposite terminal electrodes 3 and 4 extend over a pair of opposite end surfaces 2*a* and 2*b* of the insulating substrate 2 up to the reverse surface side of the insulating substrate 2.

In the above arrangement, of the two trimming grooves 9 and 10 formed in the resistor film 5, the first trimming groove 9 is provided at a portion of the resistor film 5 which is connected to the terminal electrode 3 throughout the width W. Therefore, the rate of change of resistance per unit length of the first trimming groove 9 is relatively small similarly to the prior art structure.

On the other hand, of the two trimming grooves 9 and 10, the second trimming groove 10 is provided between the first inward groove 7 and the second end edge 5*b* of the resistor film 5, which is connected to the terminal electrode 4 through the narrow portion 6. Therefore, the rate of change of resistance per unit length of the second trimming groove 10 is larger than that of the first trimming groove.

Therefore, to make the resistance between the terminal electrodes 3 and 4 lie in the predetermined rated range, the second trimming groove 10, whose rate of resistance change is large, is first formed while measuring the resistance to roughly adjust the resistance to come close to the predetermined rated value. Subsequently, the first trimming groove 9, whose rate of resistance change is small, is formed while measuring the resistance. With this technique, precise trimming adjustment to make the resistance lie within the predetermined rated range is possible.

On the assumption that the position of the trimming grooves 9 and 10 is deviated toward either end edge of the insulating substrate 2 by a slight dimension Δδ1, each of the distance A1 between the first trimming groove 9 and the second inward groove 8, the distance A2 between the first inward groove 7 and the second trimming groove 10 and the distance A3 between the second trimming groove 10 and the second end edge 5*b* of the resistor film 5 is set larger than the distance B between the first inward groove 7 and the second inward groove 8 by as much as the dimension Δδ1. In other words, each of the distances A1, A2 and A3 is set to no less than B+Δδ1. This reliably prevents the distances A1, A2 and A3 between the inward grooves 7, 8 and the trimming grooves 9, 10 from becoming smaller than the distance B between the two inward grooves 7 and 8, which are formed at the time of forming the resistor film 5 by screen printing, due to the positional deviation in machining the trimming grooves 9, 10.

Preferably, the chip resistor 1 having the above-described structure is manufactured by the following method.

Figure 3:
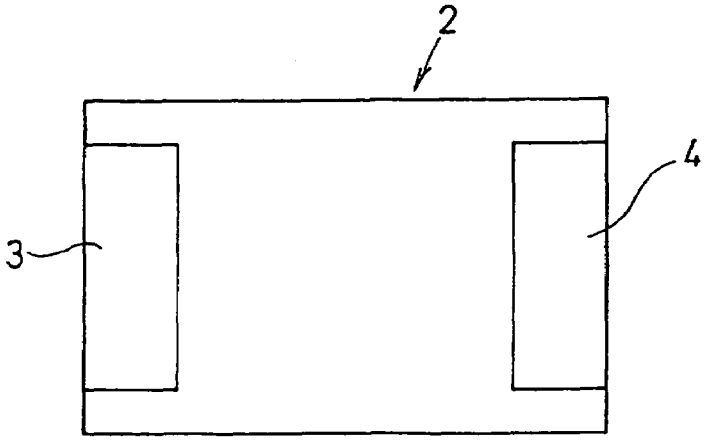
FIG. 3 shows a first step in the process of manufacturing the chip resistor of the first embodiment.
Figure 4:
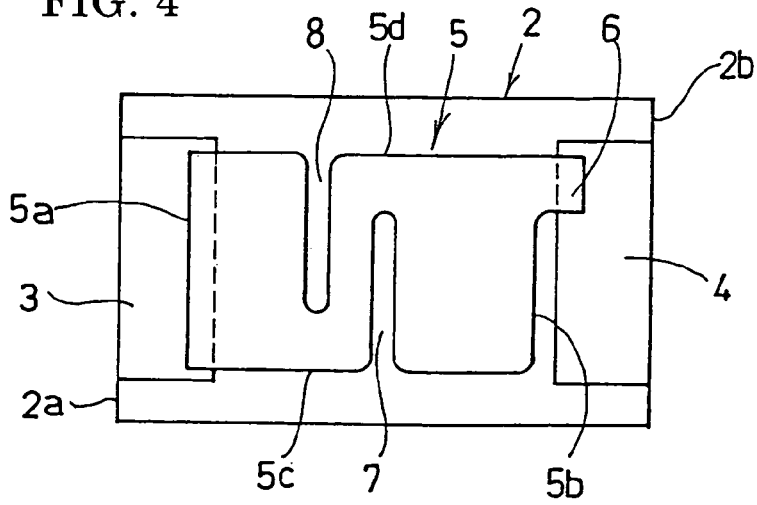
FIG. 4 shows a second step in the process of manufacturing the chip resistor of the first embodiment.

First, as shown in FIG. 3, a pair of terminal electrodes 3 and 4 is formed on the upper surface of an insulating substrate 2. Then, as shown in FIG. 4, a resistor film 5 is formed on the upper surface of the insulating substrate 2 by screen printing so that the resistor film 5 includes two inward grooves 7, 8 and a narrow portion 6 overlapping the terminal electrodes 3, 4.

Alternatively, the resistor film 5 may be formed before the terminal electrodes 3 and 4 are formed.

Figure 5:
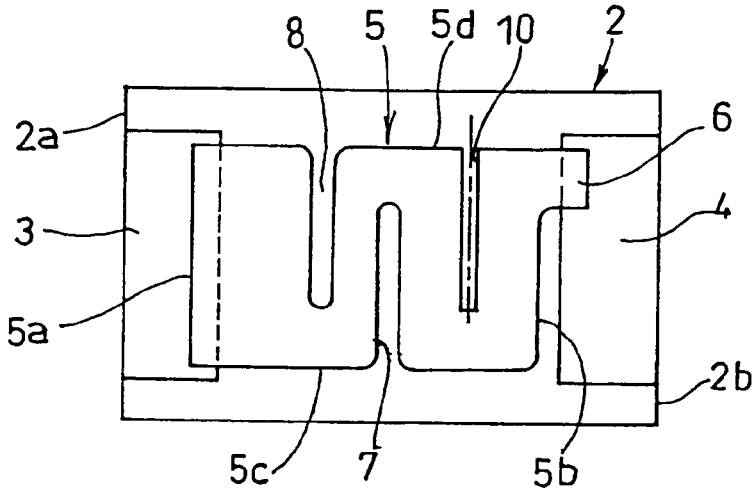
FIG. 5 shows a third step in the process of manufacturing the chip resistor of the first embodiment.

Subsequently, as shown in FIG. 5, a second trimming groove 10 is formed in the resistor film 5 by e.g. laser beam irradiation. Specifically, the second trimming groove 10 is formed while measuring the resistance between the terminal electrodes 3 and 4 and roughly adjusting the trimming so that the resistance becomes close to a predetermined rated value.

Figure 6:
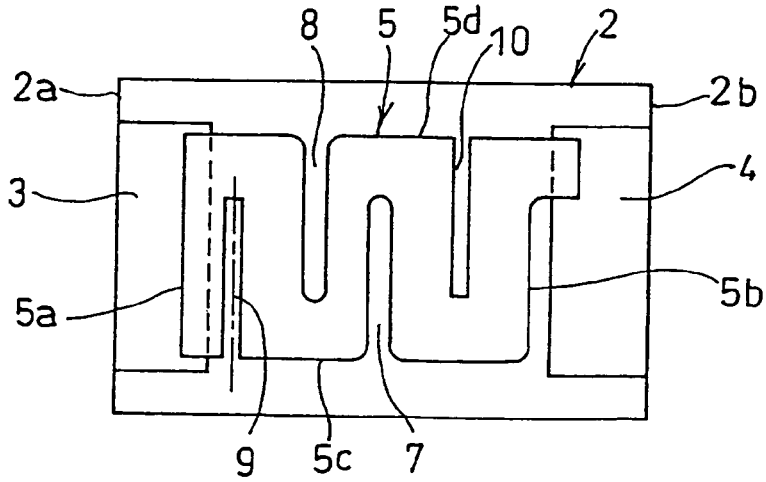
FIG. 6 shows a fourth step in the process of manufacturing the chip resistor of the first embodiment.

Then, as shown in FIG. 6, a first trimming groove 9 is formed in the resistor film 5 by e.g. laser beam irradiation. Specifically, the first trimming groove 9 is formed while measuring the resistance between the terminal electrodes 3 and 4 and precisely adjusting the trimming so that the resistance lies within the predetermined rated range.

Subsequently, a cover coat 11 for entirely covering the resistor film 5 is formed on the upper surface of the insulating substrate 2.

Figure 7:
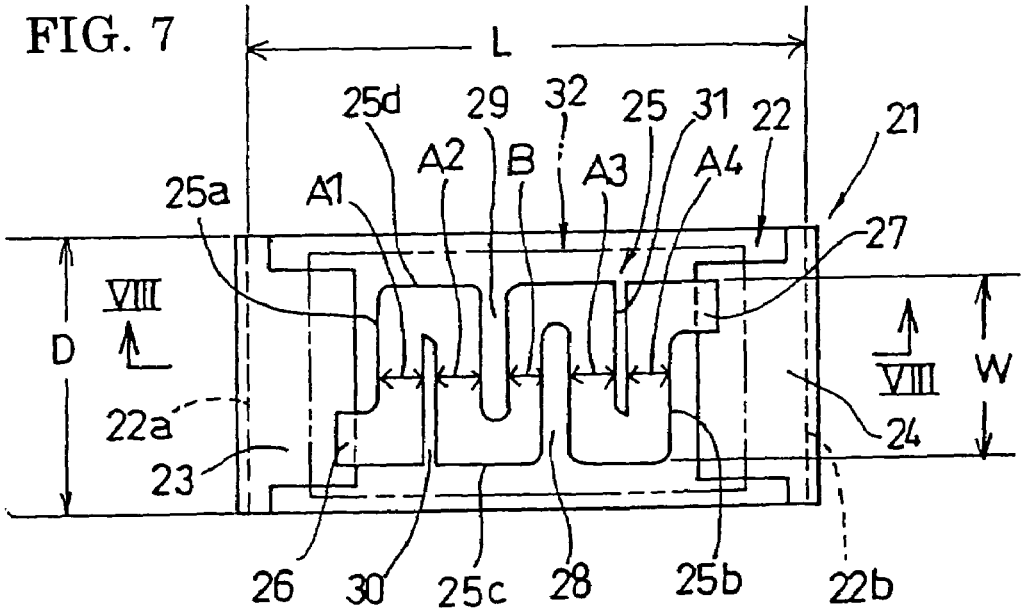
FIG. 7 is a plan view showing a chip resistor according to a second embodiment of the present invention.
Figure 8:
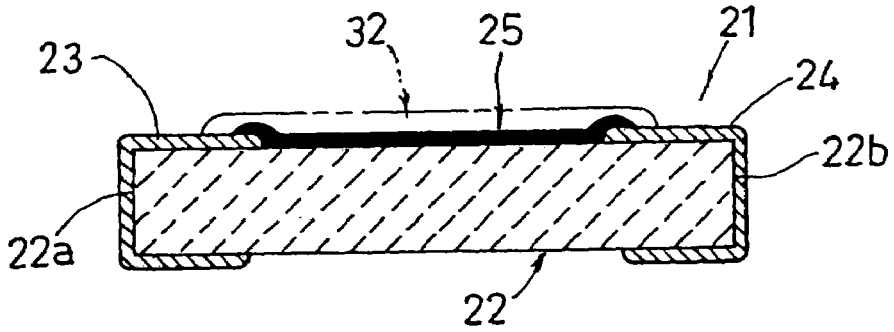
FIG. 8 is a sectional view taken along lines VIII-VIII in FIG. 7.

FIGS. 7 and 8 show a chip resistor 21 according to a second embodiment of the present invention.

The chip resistor 21 includes an insulating substrate 22 in the form of an elongated rectangular chip having a width D and a length L, terminal electrodes 23 and 24 formed on the upper surface of the insulating substrate at longitudinally opposite ends thereof, and a resistor film 25 having a width W and formed on the upper surface of the insulating substrate 22 to extend longitudinally of the insulating substrate 22 between the terminal electrodes 23 and 24. The resistor film is formed by screen printing and the subsequent baking of the material.

The resistor film 25 has a first and a second end edges 25*a* and 25*b*. Specifically, in screen printing the resistor film, a first narrow portion 26 is provided integrally at the first end edge 25*a* of the resistor film 25. Of a first and a second longitudinal edges 25*c* and 25*d* of the resistor film 25, the first narrow portion 26 is provided at the first longitudinal edge 25*c*, and the first end edge 25*a* is electrically connected to the terminal electrode 23 through the first narrow portion 26. Further, in screen printing, a second narrow portion 27 is provided integrally at the second end edge 25*b* of the resistor film 25. The second narrow portion 27 is provided at the second longitudinal edge 25*d* of the resistor film, and the second end edge 25*b* is electrically connected to the terminal electrode 24 through the second narrow portion 27. Further, the resistor film 25 includes a first inward groove 28 extending from the first longitudinal edge 25*c* toward the second longitudinal edge 25*d* and a second inward groove 29 extending from the second longitudinal edge 25*d* toward the first longitudinal edge 25*c*, which are formed in screen printing the resistor film 25.

Specifically, the first inward groove 28 and the second inward groove 29 are provided approximately at the longitudinal center of the resistor film 25 and arranged adjacent to each other so that the first inward groove 28 is positioned closer to the second end edge 25*b* of the resistor film 25 than the second inward groove, whereas the second inward groove 28 is positioned closer to the first end edge 25*a* of the resistor film 25 than the first inward groove is.

Between the first end edge 25*a* and the second inward groove 29 of the resistor film 25 is further provided a first trimming groove 30, which is formed by e.g. laser beam irradiation to extend from the first longitudinal edge 25*c* toward the second longitudinal edge 25*d*. Similarly, between the second end edge 25*b* and the first inward groove 28 of the resistor film 25 is provided a second trimming groove 31, which is formed by e.g. laser beam irradiation to extend from the second longitudinal edge 25*d* toward the first longitudinal edge 25*c*. Due to the provision of the two inward grooves 28, 29 and the two trimming grooves 30, 31, the resistor film 25 has a winding shape.

Indicated by the reference sign 32 is a cover coat, which is formed to entirely cover the resistor film 25 after the two trimming grooves 30 and 31 are formed. The opposite terminal electrodes 23 and 24 extend over a pair of opposite end surfaces 22*a* and 22*b* of the insulating substrate 22 up to the reverse surface side of the insulating substrate 22.

With this arrangement, the number of turns in the winding shape of the resistor film 25, which is provided by the two inward grooves 28, 29 and the two trimming grooves 30, 31, can be made equal to that in the prior art structure. Unlike the prior art structure, the first trimming groove 30 and the second trimming groove 31 are not arranged adjacent to each other but spaced from each other with the two inward grooves 28 and 29 interposed therebetween. Therefore, even when the trimming grooves 30 and 31 come close to each other due to the positional deviation in individually forming the grooves by trimming, the distances between the two inward grooves 28, 29 and the two trimming grooves 30, 31 can be reliably prevented from becoming smaller than a predetermined value without the need for increasing the length L of the insulating substrate 2.

On the assumption that the position of the trimming grooves 30 and 31 is deviated toward either end edge of the insulating substrate 22 by a slight dimension Δδ2, each of the distance A1 between the first trimming groove 30 and the first end edge 25*a* of the resistor film 25, the distance A2 between the first trimming groove 30 and the second inward groove 29, the distance A3 between the first inward groove 28 and the second trimming groove 31 and the distance A4 between the second trimming groove 31 and the second end edge 25*b* of the resistor film 25 is set larger than the distance B between the first inward groove 28 and the second inward groove 29 by as much as the dimension Δδ2. In other words, each of the distances A1, A2, A3 and A4 is set to no less than B+Δδ2. This reliably prevents the distances A1, A2, A3 and A4 between the inward grooves 28, 29 and the trimming grooves 30, 31 from becoming smaller than the distance B between the two inward grooves 28 and 29, which are formed at the time of forming the resistor film 5 by screen printing, due to the positional deviation in machining the trimming grooves 30, 31.

Preferably, the chip resistor 21 having the above-described structure is manufactured by the following method.

Figure 9:
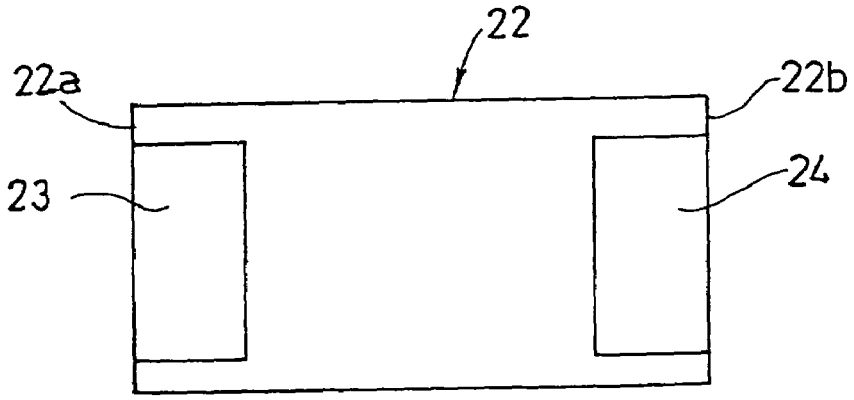
FIG. 9 shows a first step in the process of manufacturing the chip resistor of the second embodiment.
Figure 10:
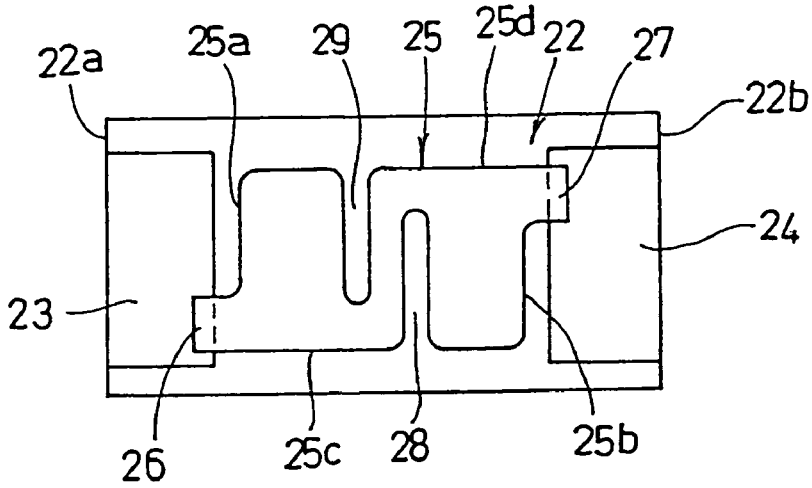
FIG. 10 shows a second step in the process of manufacturing the chip resistor of the second embodiment.

First, as shown in FIG. 9, a pair of terminal electrodes 23 and 24 is formed on the upper surface of an insulating substrate 22. Then, as shown in FIG. 10, a resistor film 25 is formed on the upper surface of the insulating substrate 22 by screen printing so that the resistor film 25 includes two narrow portions 26 and 27 respectively overlapping the terminal electrodes 23 and 24, and two inward grooves 28 and 29.

Alternatively, the resistor film 25 may be formed before the terminal electrodes 23 and 24 are formed.

Figure 11:
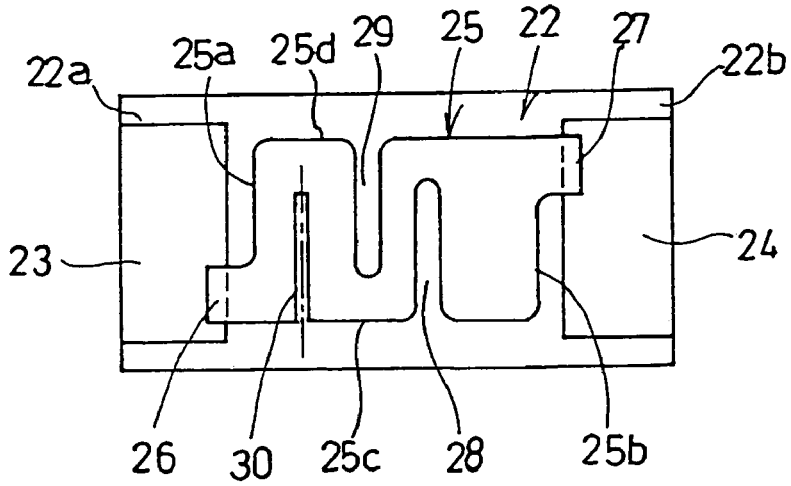
FIG. 11 shows a third step in the process of manufacturing the chip resistor of the second embodiment.

Subsequently, as shown in FIG. 11, a first trimming groove 30 is formed in the resistor film 25 by e.g. laser beam irradiation.

Specifically, the first trimming groove 30 is formed while measuring the resistance between the terminal electrodes 23 and 24 to roughly adjust the resistance to come close to the predetermined rated value.

Figure 12:
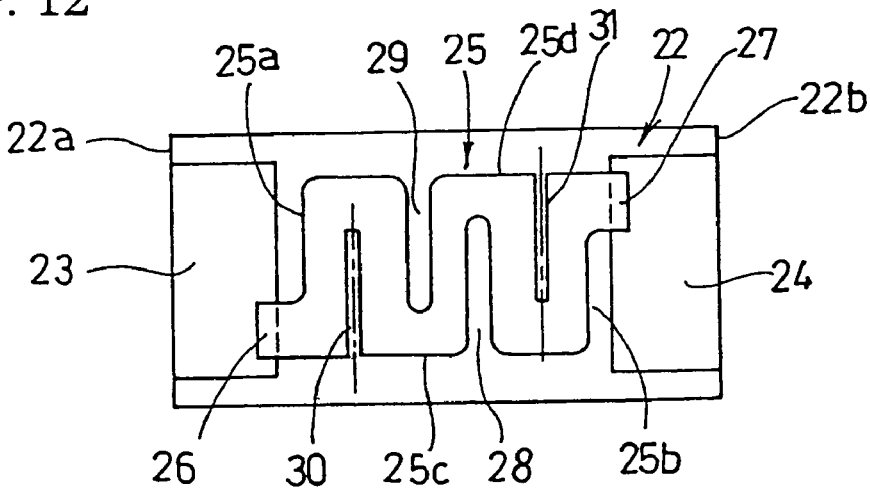
FIG. 12 shows a fourth step in the process of manufacturing the chip resistor of the second embodiment.
Figure 13:
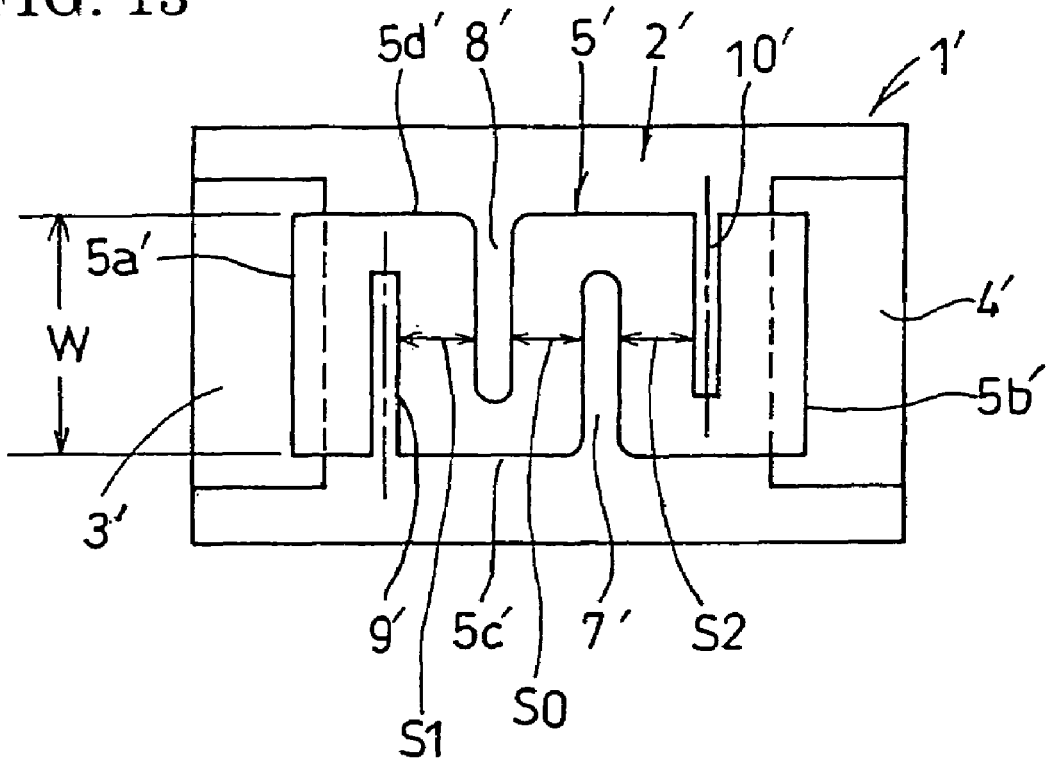
FIG. 13 is a plan view showing a prior art chip resistor.
Figure 14:
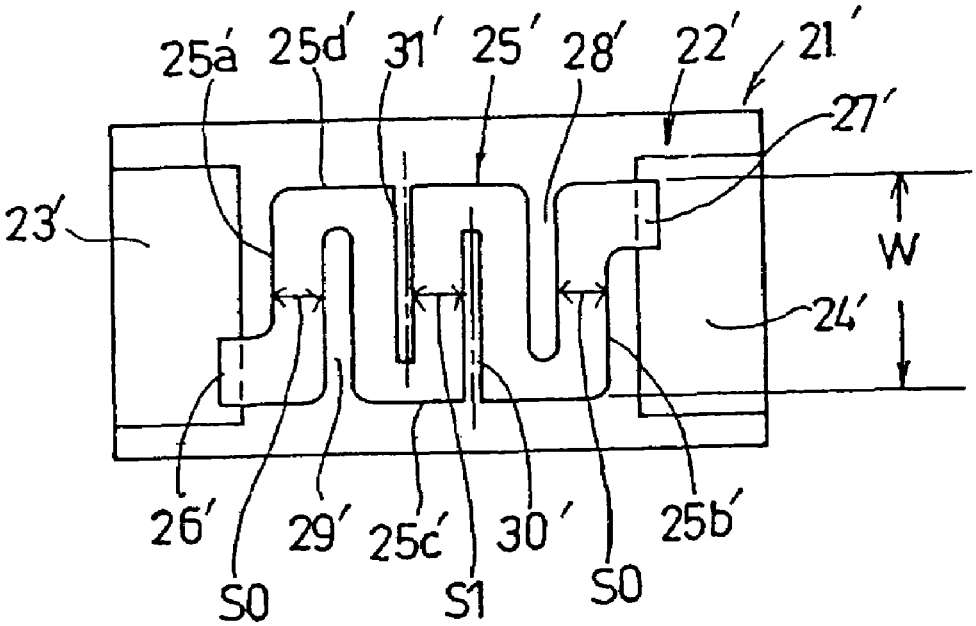
FIG. 14 is a plan view showing another prior art chip-resistor.

Then, as shown in FIG. 12, a second trimming groove 31 is formed in the resistor film 25 by e.g. laser beam irradiation.

Specifically, the second trimming groove 31 is formed while measuring the resistance between the terminal electrodes 23 and 24 and precisely adjusting the trimming so that the resistance lies within the predetermined rated range.

Subsequently, a cover coat 32 for entirely covering the resistor film 25 is formed on the upper surface of the insulating substrate 22.

Alternatively, in the above-described method, the first trimming groove 30 may be formed after the second trimming groove 31 is formed while precisely adjusting the trimming so that the resistance lies in the predetermined rated range.

The invention claimed is:

1. A chip resistor comprising an insulating substrate in a form of a chip, a pair of terminal electrodes formed on an upper surface of the insulating substrate at opposite ends of the upper surface, and a resistor film formed by screen printing on the upper surface of the insulating substrate and elongated between the terminal electrodes to have a predetermined width to include a first and a second longitudinal edges and a first and a second end edges, the resistor film including a first inward groove extending from the first longitudinal edge toward the second longitudinal edge, and a second inward groove extending from the second longitudinal edge toward the first longitudinal edge, the first and the second inward grooves being formed simultaneously in forming the resistor film by screen printing, wherein the first end edge of the resistor film is electrically connected to one of the terminal electrodes throughout the width of the resistor film, whereas the second end edge of the resistor film is electrically connected to the other one of the terminal electrodes via a narrow portion provided at the second longitudinal edge, the first and the second inward grooves being provided approximately at the longitudinal center of the resistor film and arranged adjacent to each other so that the first inward groove is positioned closer to the second end edge than the second inward groove is, whereas the second inward groove is positioned closer to the first end edge than the first inward groove is, and wherein, the resistor film further includes a first trimming groove formed between the first end edge of the resistor film and the second inward groove by trimming and extending from the first longitudinal edge toward the second longitudinal edge, and a second trimming groove formed between the second end edge of the resistor film and the first inward groove by trimming and extending from the second longitudinal edge toward the first longitudinal edge.

2. The chip resistor according to claim 1, wherein each of distance between the first trimming groove and the second inward groove, distance between the first inward groove and the second trimming groove and distance between the second end edge of the resistor film and the second trimming groove is set larger than distance between the first inward groove and the second inward groove by as much as amount of positional deviation in trimming to form the trimming grooves.

3. A method of manufacturing a chip resistor, comprising the steps of forming terminal electrodes on an upper surface of an insulating substrate in a form of a chip at opposite ends of the upper surface, and forming a resistor film between the terminal electrodes on the upper surface of the insulating substrate by screen printing so that the resistor film includes a first and a second longitudinal edges and a first and a second end edges, wherein the step of forming the resistor film by screen printing includes electrically connecting the first end edge of the resistor film to one of the terminal electrodes throughout a width of the resistor film, forming a narrow portion integrally at the second end edge of the resistor film so that the narrow portion is electrically connected to the other one of the terminal electrodes at the second longitudinal edge of the resistor film, and forming a first inward groove extending from the first longitudinal edge toward the second longitudinal edge and a second inward groove extending from the second longitudinal edge toward the first longitudinal edge in the resistor film, and wherein the method further comprises the step of forming, by trimming, a first trimming groove extending from the first longitudinal edge toward the second longitudinal edge between the first end edge of the resistor film and the second inward groove and the step of forming, by trimming, a second trimming groove extending from the second longitudinal edge toward the first longitudinal edge between the second end edge of the resistor film and the first inward groove.

4. A chip resistor comprising an insulating substrate in a form of a chip, a pair of terminal electrodes formed on an upper surface of the insulating substrate at opposite ends of the upper surface, and a resistor film formed by screen printing on the upper surface of the insulating substrate and elongated between the terminal electrodes to have a predetermined width to include a first and a second longitudinal edges and a first and a second end edges, the resistor film including a first narrow portion integrally formed at the first end edge and electrically connected to one of the terminal electrodes at the first longitudinal edge of the resistor film, a second narrow portion integrally formed at the second end edge and electrically connected to the other one of the terminal electrodes at the second longitudinal edge of the resistor film, a first inward groove extending from the first longitudinal edge toward the second longitudinal edge, and a second inward groove extending from the second longitudinal edge toward the first longitudinal edge, the first and the second inward grooves being formed simultaneously in forming the resistor film by screen printing, wherein the first and the second inward grooves are provided approximately at the longitudinal center of the resistor film and arranged adjacent to each other so that the first inward groove is positioned closer to the second end edge than the second inward groove is, whereas the second inward groove is positioned closer to the first end edge than the first inward groove is, and wherein, the resistor film further includes a first trimming groove formed between the first end edge of the resistor film and the second inward groove by trimming and extending from the first longitudinal edge toward the second longitudinal edge, and a second trimming groove formed between the second end edge of the resistor film and the first inward groove by trimming and extending from the second longitudinal edge toward the first longitudinal edge.

5. The chip resistor according to claim 4, wherein each of distance between the first end edge of the resistor film and the first trimming groove, distance between the first trimming groove and the second inward groove, distance between the first inward groove and the second trimming groove and distance between the second end edge of the resistor film and the second trimming groove is set larger than distance between the first inward groove and the second inward groove by as much as amount of positional deviation in trimming to form the trimming grooves.

6. A method of manufacturing a chip resistor, comprising the steps of forming terminal electrodes on an upper surface of an insulating substrate in a form of a chip at opposite ends of the upper surface, and forming a resistor film between the terminal electrodes on the upper surface of the insulating substrate by screen printing so that the resistor film includes a first and a second longitudinal edges and a first and a second end edges, wherein the step of forming the resistor film by screen printing includes forming a first narrow portion integrally at the first end edge of the resistor film so that the first narrow portion is electrically connected to the one of the terminal electrodes at the first longitudinal edge of the resistor film, forming a second narrow portion integrally at the second end edge of the resistor film so that the second narrow portion is electrically connected to the other one of the terminal electrodes at the second longitudinal edge of the resistor film, and forming a first inward groove extending from the first longitudinal edge toward the second longitudinal edge and a second inward groove extending from the second longitudinal edge toward the first longitudinal edge in the resistor film, and wherein the method further comprises the step of forming, by trimming, a first trimming groove extending from the first longitudinal edge toward the second longitudinal edge between the first end edge of the resistor film and the second inward groove and the step of forming, by trimming, a second trimming groove extending from the second longitudinal edge toward the first longitudinal edge between the second end edge of the resistor film and the first inward groove.

* * * * *